US008141968B2

(12) United States Patent
Velarde et al.

(10) Patent No.: US 8,141,968 B2
(45) Date of Patent: Mar. 27, 2012

(54) SUPPORT BEAM FOR A CABINET DRAWER

(75) Inventors: Victor Gerardo Cabal Velarde, Queretaro (MX); Alan Federico Camacho Velazquez, Tlalnepantla de Baz (MX); Ignacio Marín Ahumada, Queretaro (MX); Carlos Espinosa de los Monteros Fernández, Naucalpan (MX)

(73) Assignee: Mabe, S.A. de C.V., Queretaro (MX)

( * ) Notice: Subject to any disclaimer, the term of this patent is extended or adjusted under 35 U.S.C. 154(b) by 467 days.

(21) Appl. No.: 12/424,625

(22) Filed: Apr. 16, 2009

(65) Prior Publication Data

US 2009/0261698 A1 Oct. 22, 2009

(30) Foreign Application Priority Data

Apr. 17, 2008 (MX) ..... MX/A/2008/005013

(51) Int. Cl.
*A47B 88/12* (2006.01)

(52) U.S. Cl. ..... 312/402; 312/331

(58) Field of Classification Search ..... 312/402, 312/404, 408, 410, 330.1, 331, 334.1, 334.7, 312/334.8; 384/18, 20, 22; 74/422; 62/382
See application file for complete search history.

(56) References Cited

U.S. PATENT DOCUMENTS

| | | | | |
|---|---|---|---|---|
| 2,065,391 | A | 12/1936 | Nance | |
| 2,103,885 | A | 12/1937 | Whalen | |
| 2,241,053 | A | 5/1941 | Brightman | |
| 2,711,944 | A | 6/1955 | Meek | |
| 3,133,768 | A | 5/1964 | Klakovich | |
| 4,324,439 | A * | 4/1982 | Hagen et al. | 384/18 |
| 4,788,832 | A | 12/1988 | Aoki | |
| 4,936,641 | A | 6/1990 | Bussan et al. | |
| 5,310,255 | A | 5/1994 | Ranallo | |
| 5,893,620 | A | 4/1999 | Birgelis | |
| 5,947,574 | A | 9/1999 | Avendano | |
| 5,980,009 | A | 11/1999 | Atalla | |
| 6,447,083 | B1 | 9/2002 | Chiapetta | |
| 6,449,976 | B1 | 9/2002 | Chai et al. | |
| 6,565,170 | B2 | 5/2003 | Banicevic | |
| 6,609,774 | B2 | 8/2003 | Banicevic | |
| 6,779,859 | B2 | 8/2004 | Koons | |
| 6,834,922 | B2 | 12/2004 | Cho | |
| 6,961,988 | B2 | 11/2005 | Koons | |
| 6,971,730 | B2 | 12/2005 | Koons | |
| 7,240,980 | B2 | 7/2007 | Koons | |
| 7,430,937 | B2 * | 10/2008 | Rotter et al. | 74/422 |
| 7,594,707 | B2 * | 9/2009 | Kunkle et al. | 312/402 |
| 2001/0054296 | A1 | 12/2001 | Kaiser | |

(Continued)

FOREIGN PATENT DOCUMENTS

| | | |
|---|---|---|
| JP | 8240378 | 9/1996 |

(Continued)

*Primary Examiner* — James O Hansen
(74) *Attorney, Agent, or Firm* — Enrique J. Mora; Beusse Wolter Sanks Mora & Maire, P.A.

(57) ABSTRACT

A cabinet drawer support beam is provided, and may include on an upper part of such beam, a rail or longitudinal sliding mechanism. An alignment mechanism may be fastened to the rail or longitudinal mechanism. The alignment mechanism may include a pinion that runs in the rack of the lower part of the support beam, and the support beam may be fastened to the cabinet wall by way of barrels and/or fasteners. At least two beams per cabinet may be included.

15 Claims, 11 Drawing Sheets

U.S. PATENT DOCUMENTS

2003/0189395 A1* 10/2003 Doornbos et al. ..... 312/334.1
2004/0164654 A1 8/2004 Laible
2005/0160854 A1 7/2005 Rotter
2006/0250059 A1* 11/2006 Lemm ..... 312/331
2007/0227180 A1 10/2007 Koons

FOREIGN PATENT DOCUMENTS

JP 2005241209 9/2005

* cited by examiner

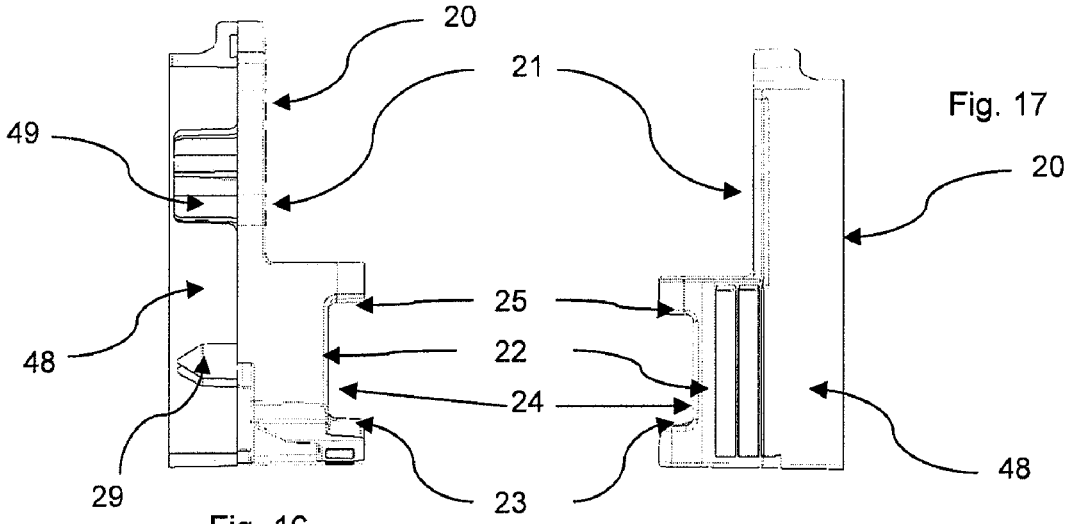
Fig. 16
Fig. 17
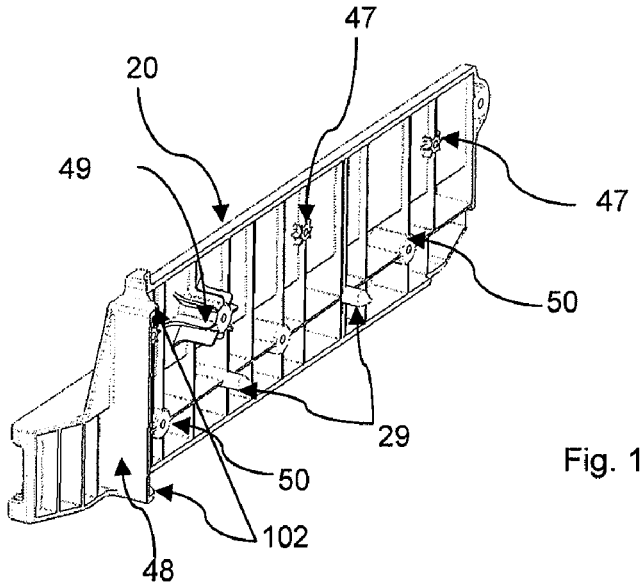
Fig. 18

SUPPORT BEAM FOR A CABINET DRAWER

RELATED APPLICATIONS

This application claims priority from Mexican application Serial No. MX/a/2008/005013 filed Apr. 17, 2008, which is incorporated herein by reference in its entirety.

FIELD OF THE INVENTION

The present invention refers to a set of support beams along with a drawer mechanism, and its method of assembly, and more particularly, to a mechanism for supporting drawers in a horizontal axis, for cabinets in general, preferably, however not limited to, the field of refrigerators and freezers, as well as an assembly method thereof.

BACKGROUND OF THE INVENTION

During the last few years, bottom mount refrigerators, with drawers in their bottom part, have been re-introduced in the market. A refrigerator with a drawer in its lower part has the fresh food compartment placed vertically in the upper part of a drawer or freezing compartment. The freezing compartment is usually smaller than the fresh food compartment.

There are different types of mounting mechanisms to close the front access of the lower drawer. In one embodiment, the freezer door is mounted with hinges to the refrigerator compartment cabinet, to allow the door to rotate in a vertical axis to open. In another embodiment, the door rolls or rotates in a horizontal axis.

In yet another embodiment of lower drawer mounting, said drawer slides moving horizontally relative to the refrigerator compartment. In this embodiment, the door inner cover or liner is fixed with rails that extend telescopically from the freezer compartment to allow the front door to slide in a horizontal axis relative to said compartment, to carry out the respective aperture and closure of the freezer compartment. Typically, this sliding compartment has a drawer or container, in which food articles are stored, and are accessible to the user when the door slides to open the compartment. In general, the articles that are stored in the drawer or container within the compartment, are articles with a given weight, and they tend to gain weight when frozen. Therefore a mechanism capable of supporting a substantial weight is needed, as well as a reliable, economic and easy to mount is needed.

In the art, the drawers had rails that did not correctly distribute the weight of the drawer, and were directly mounted to the compartment liner walls. An example of this, is U.S. Pat. No. 4,936,641, which discloses mounting system for an article supporting member in a refrigerator includes first and second support members, each one is secured and mounted to the compartment liner lateral walls so that the height member of the support members may be adjusted. In another patent which discloses similar rails, that are not telescopic, is U.S. Pat. No. 5,980,009, wherein the rails uses ball bearings to slide the drawer by means of beams. Another patent that discloses this type of rails, is U.S. Pat. No. 4,788,832, wherein the rail support is directly attached to the freezer compartment liner.

Telescopic rails in refrigerators were disclosed in U.S. Pat. No. 2,103,885, which discloses a refrigerator capable of increasing wasted space for increasing refrigerator capacity. Another telescopic rail disclosed in the art, is that of U.S. Pat. No. 2,711,944. In said patent, the telescopic rails are supported by a pair of angled brackets, at the same time, the supports are directly fixed to the liner.

There are several patents that disclose in the art rails or telescopic rails, as well as rail supports to mount drawers with substantial weight. For example, U.S. Pat. No. 6,971,730, discloses a freezer drawer, specifically a mechanism to mount drawers to a refrigerator compartment. The drawer uses a pair of lateral adapters having a front section and a respective canal. Rails for the drawer, which are telescopic, are mounted to the canal of the first and second lateral adapters, with the disadvantage that these rails are loose within the canal. As seen in FIG. 5, an upper lug shown with numeral 127, lies over the upper groove of the liner, shown with numeral 66. On the other hand, a lower lug shown with numeral 147, lines over the lower groove of the liner, shown with numeral 67. This effect of resting the rail support over the liner, creates friction between the parts, that will eventually lead to the deterioration of the pieces, being a non-desired problem. Having the lugs in the rail support and grooves in the liner, makes the assembly of the parts a complicated and costly process. Additionally, the mold to make the rail support, with said grooves, is difficult to achieve and produce, being that the tolerances of the process are minimum in view of the grooves and lugs, since the product has to be cooled for assembly, otherwise, it is possible that the product may fracture or even break. Having lugs in the rail support, gives the rail support little adaptability to different compartment models, for example, the rail support may not be coupled to flat walls, unless the wall has grooves as those disclosed by said patent. Additionally, having said grooves also renders a rail support which is inadaptable to different freezer models. Having lugs in the rail support that lies over the compartment liner wall grooves, creates the disadvantage that when the drawer slides in a horizontal axis, the rail support moves, and therefore, the whole drawer may be extracted in an unaware manner, further to creating instability in view of the drawer's weight. The quantity of material used to achieve the rail support in said patent, is excessive, in view of the wasted material parts, as is found in the upper wall, shown with numeral 97. Being that the used material quantity by said patent is greater, the final product is heaver, thus, having as a repercussion the deterioration of the wall. The section for fixing the drawer to the rails while sliding in a horizontal axis towards the outer part with regards to the upper compartment, shown with numeral 188, which is observed in FIG. 2 of said patent, does not totally stop the drawer, that is, if the mechanism is oppressed towards the inner part, the drawer may be easily loosened. The US patent does not disclose or suggest the use of a rack and pinion separate to the rail, as does the present invention so that the rails may synchronically slide the same length. This patent, has as part of its family, U.S. Pat. No. 7,240,980 and U.S. patent application Ser. No. 11/758,169, with publication No. 2007/0227180.

None of the prior art documents disclose a rail mechanism and a rail support mechanism that is easy to assemble and that may be adapted to any type of wall. Furthermore, none of the prior art documents disclose a slide mechanism and a drawer support mechanism that is easy to produce.

Therefore, the above mentioned problematic exists in the prior art. An additional problem is that a rail and a rail support mechanism that are easy to assemble and produce, which at the same time have a high adaptability to different types of walls is not disclosed. Likewise, there are not rail supporting or fastening mechanisms that are capable of sustaining a substantial weight, without resting over the wall grooves. In view of the above, there are not rail supporting or fastening mechanisms that do not deteriorate the wall on which it rests, and as a consequence, its life expectancy is diminished. The rails and rail support mechanisms that are capable of sustaining substantial weight and not deteriorating the walls, require a great quantity of materials to be made.

A further problem is that the drawers may be unexpectedly removed by a user. Yet another problem found in the telescopic rails of the art, is that when opening or closing the drawer, i.e. when sliding the drawer in a horizontal axis, the lateral ends of the drawer tend to misalign creating a non-uniform sealing of the drawer door with regards to the compartment.

BRIEF DESCRIPTION OF THE INVENTION

The present invention contemplates a rail mechanism or a longitudinal sliding mechanism and a mechanism to sustain said rail, that work together. The rail mechanism and its support, are specially contemplated for the use of heavy weight drawers, however, are not limited to said drawers, since they may be adaptable to any type of drawer. Likewise, the slide mechanism and its support are specially contemplated for their use in refrigerators, specifically for freezer compartments, and may be adaptable to any type of liner or said compartments, however, may be used in any type of wall and compartment, independent of the temperature that said compartment may have, for example a high temperature compartment, as may be an oven, adapting only the part materials.

The drawer mechanism is specially contemplated for a refrigerator of the type of a bottom mount refrigerator, and requires the use of two baskets, an upper with rails moving in a telescopic manner, and an intermediate basket that is supported in the grooves of the compartment or liner, since the rack is found in the lower part of the level of the telescopic rails, however, may be used in different situations. In a non-limitative exemplary manner, the mechanism of the present invention may be used in a washing machine or an oven, wherein the washing machine door may be, instead of the traditional rotatable aperture in the lower axis of the door, slidable in a horizontal axis. Additionally, this type of drawer mechanism, may be provided in an ordinary furniture that requires sustaining considerable weight. It should be clear that the only requirement of said drawer is that it is slidable and telescopic and that, even if only exemplified with refrigerators, the mechanism of the present invention may be adapted to several situations.

The drawer mechanism of the present invention is a telescopic mechanism that comprises as essential pieces a rail (also called longitudinal sliding mechanism) and a rail support mechanism. The rail is capable of sustaining a drawer or basket, in which products are stored within the compartment. The rail is capable of sliding in a horizontal axis with regards to the compartment, being that the compartment is in a fixed position.

The rail and rail support mechanism have a mechanic design different to those already known. In the back part of the rail support mechanism or longitudinal sliding mechanism, locaters of said mechanism are found in the same axis. So as to spare material, the back part of the rail support mechanism is substantially hollow. In the front part, the rail support mechanism has to main parts. A main upper part, wherein the rail will be fixed and supported by means of fixing means, that may be threaded pieces and pieces to be threaded, such as in a non-limitative exemplary manner, screws and nuts of the rail support mechanism. Said first upper part, contains at least one of said fixing means. It should be clear that if the fixing means is distributed in a better manner with regards to the rail support mechanism and with regards to the drawer maximum calculated weight, a better fastening will be achieved by said mechanism. Additionally, it is clear that a greater number of fixing means throughout the rail supporting or fastening mechanism, will help distribute the drawer weight. A second loser part of the rail support mechanism, contains a lower wall, and a lateral wall and an upper wall, wherein, in said lower wall a rack encloses a parallel mechanism pinion. The rack in its valleys comprises holes, with a longitude equivalent to the width and length of the pinions teeth, so that if liquid or solid is spilt, said liquid or solid does not stay in the teeth of said pinion or in the valleys of said rack, which would cause an asynchronous run of the drawer and an unequal feeling for the user when sling the drawer in a horizontal axis. The crests of the rack have the same height and inclination along the length of said rack.

The telescopic rail, has a proper and particular mechanic design. The rail is capable of being supported only by the above-mentioned support means. That is, the rail is coupled to the rail support mechanism and the rail support mechanism is coupled to the wall by the same fixing means. The rail is designed to be fastened and supported by the rail fixing means, as well as being designed to not touch, and consequently not to rest its rail weight over the lower wall of the first upper part of the rail support mechanism, i.e. the rail does not rest over the rail support mechanism.

Each rail additionally counts with a mechanism for helping that the rail mechanism of the present invention, while sliding on a horizontal axis, be extracted and introduced in a parallel and synchronic manner, creating a uniform seal throughout the door frame with regards to the compartment. Furthermore, said mechanism, which will be called "parallel mechanism" here-in-forth, allows that during the sliding in a horizontal axis of the drawer, the user feels a uniform sliding, easing the extraction and introduction of the drawer. The parallel mechanism pinion, is found in a vertical axis different to said rails, wherein a rack of the rail support mechanism is found. The parallel mechanism is fixed by a fixing device to the rail, thus, when sliding in a telescopic manner, the rail and the parallel mechanism, by means of its pinion and the rack of the rail support mechanism second part, synchronically run the same length that the rail. The pinion is capable of running throughout the rack provided in the rail support mechanism without drawing out of its race, in view that at least one projection in the arm above the pinion, is part of the parallel mechanism and in view of the limited race of the drawer. The parallel mechanism is joined by a rod, to the opposed parallel mechanism provided in opposed lateral end rail, which allows a synchrony between parallel mechanisms. Additionally, the parallel mechanism pinion, is designed in such a manner that it reduces the possible contact friction between the pinion and the rail support mechanism.

Therefore, it is an object of the present invention, to provide a rail mechanism and a rail support mechanism that is easy to assemble and produce and that may be adapted to any type of wall.

Another object of the present invention is providing a rail support mechanism that does not rest over the wall grooves, and thus a further object of the present invention is providing a rail mechanism and a rail support mechanism that does not deteriorate the walls. Being another object, providing a drawer capable of sustaining considerable weight amounts without having the rail support mechanism rest over the grooves of a wall.

Yet another object of the present invention is making a rail mechanism and a rail support mechanism that is ease to produce with few materials, and thus, it is yet a further object to lower production cost of the drawer mechanism.

Another object of the present invention is providing a drawer, a rail support and a rail that is unmovable, that is, that the user in an unexpected manner, may remove the drawer from the compartment.

Yet a further object of the present invention, is providing a drawer capable of being extracted in a parallel and equal manner in both its lateral ends when sliding in a horizontal axis.

Other objects and advantages of the present invention will become clear when taking into account the specification along with the following figures.

BRIEF DESCRIPTION OF THE FIGURES

The particular features and advantages of the invention, as well as other objects of the invention, will become clear of the following specification, taken in connection with the following figures, which:

FIG. 16 is a frontal view of the rail fastening mechanism.

FIG. 17 is a right lateral perspective view for fastening the rail.

FIG. 18 is a cross-section view of one example embodiment of the drawer mechanism embodying aspects of the present invention.

DETAILED DESCRIPTION OF THE INVENTION

The present description is carried out in an exemplary manner in regards to a refrigerator, however, the drawer mechanism of the present invention includes, however is not limited to: refrigerators, washing machines, dish washing machines, ovens and conventional drawers, and any other type of compartment.

Figure 1:
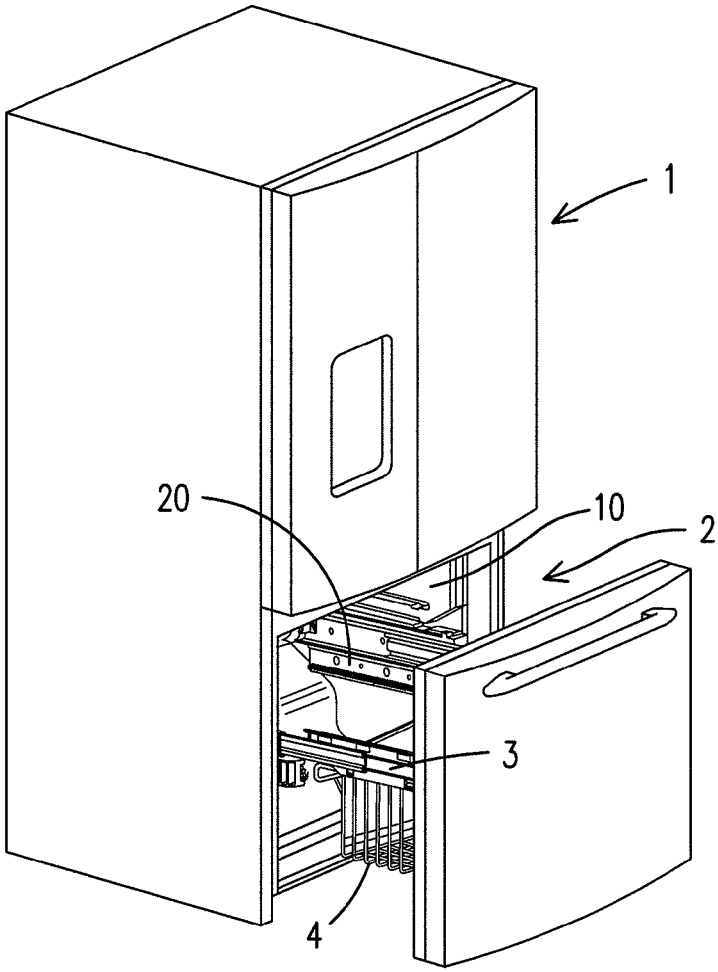
FIG. 1 is a perspective view of a bottom mount refrigerator.

In FIG. 1, a refrigerator with an upper compartment (1) and a lower compartment or drawer (2) is shown. The lower compartment (2) comprises a basket (4) fixed to rails (3), which slide in a horizontal axis opening and closing the lower compartment (2). The basket is capable of storing products. The slides (3) are fixed to the wall (10) of the lower compartment (2) by means of a support beam (20) to fasten the rail (3).

Figure 2:
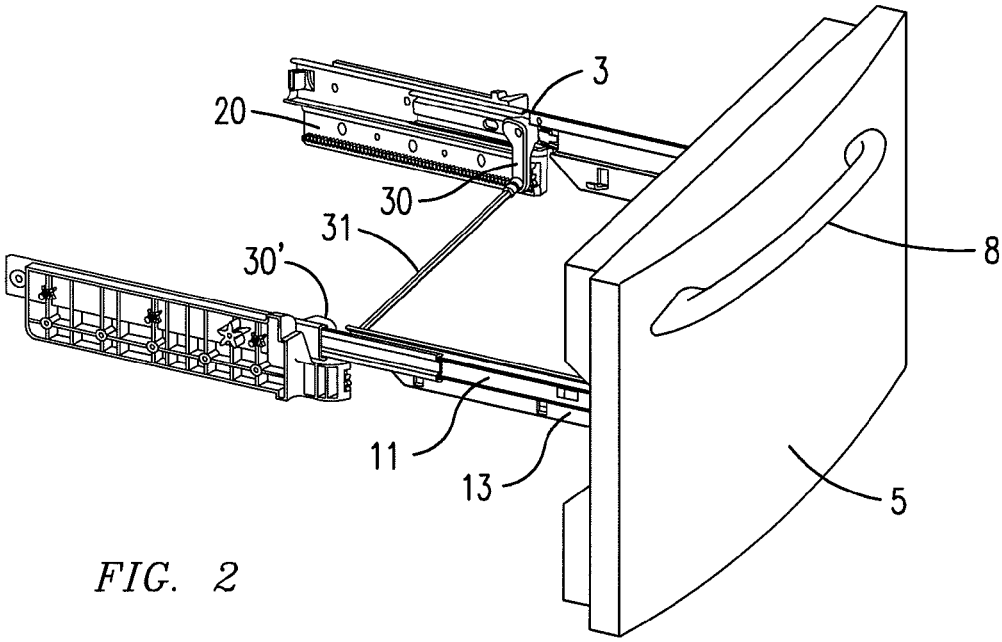
FIG. 2 is a perspective view of a drawer mechanism embodying aspects of the present invention and a bottom door of the refrigerator.

In FIG. 2 a conventional perspective view of the mechanism of the present invention is shown, however, different to FIG. 1, the mechanism shown in FIG. 2 is directed to a mechanism to any type of apparatus or conventional drawer. The adaptability of the mechanism will be explained with greater detail in the following paragraphs. A door (5), which opens and closes the access to the lower compartment (2) is fixed to the front end (6) of the rail (3) by means of a support (13). When the user pulls or pushes the door (5) handle (8), the user creates sufficient force in a horizontal axis to slide the door (5), basket (4) and basket (4) contents by means of the slides (3). The support beam (20) that supports the slides (3) should be fixed to the lateral wall (10) of the lower compartment (2) in a correct manner, otherwise, the user might extract in an unexpected manner the drawer or lower compartment (2) and its content. Additionally, it is usual that when the user pushes or pulls the handle (8), said user pushes or pulls one of the two lateral ends of the handle (8) and not from the central part of said handle (8). Therefore, when pushing or pulling from a lateral end of the handle (8), a greater traction force to slide one of the two sides of the drawer mechanism is made, causing an asynchronical sliding of the rails, and causing that the drawer or lower compartment (2) to get stuck during its sliding. Therefore, to solve this problem, the present drawer mechanism has an alignment mechanism (30) that has a rod (31) communicating the first alignment mechanism (30) of a rail with an opposed second alignment mechanism (30'), assuring that the traction of both rails (3) to be always synchronous and parallel.

As mentioned above, the rail (3) is fixed to a support beam (20) as will be shown in the following figures.

Figure 3:
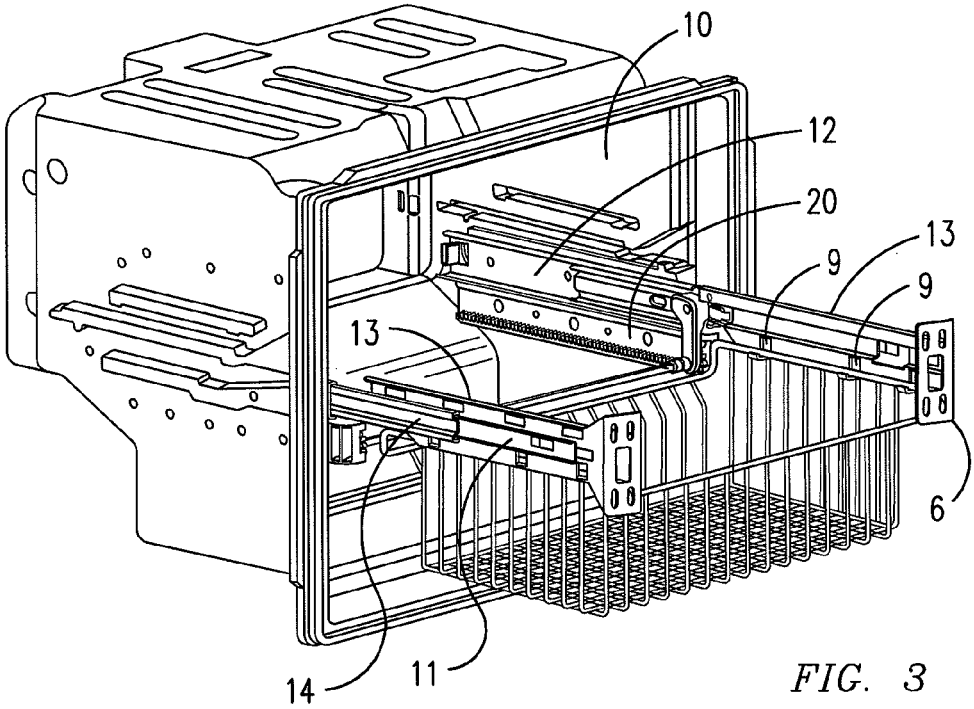
FIG. 3 is a perspective view of the drawer mechanism in a compartment.

The basket (4) is fixed to the rail (3) by means of projections (9), as may be seen in FIG. 3. The projections (9) are distributed throughout the mobile vehicle (11) of the rail (3), wherein the projections (9) are located in such a manner throughout said mobile vehicle (11) to help distribute the basket (4) weight, taking into account the calculated maximum weight for the basket (4).

Figure 4:
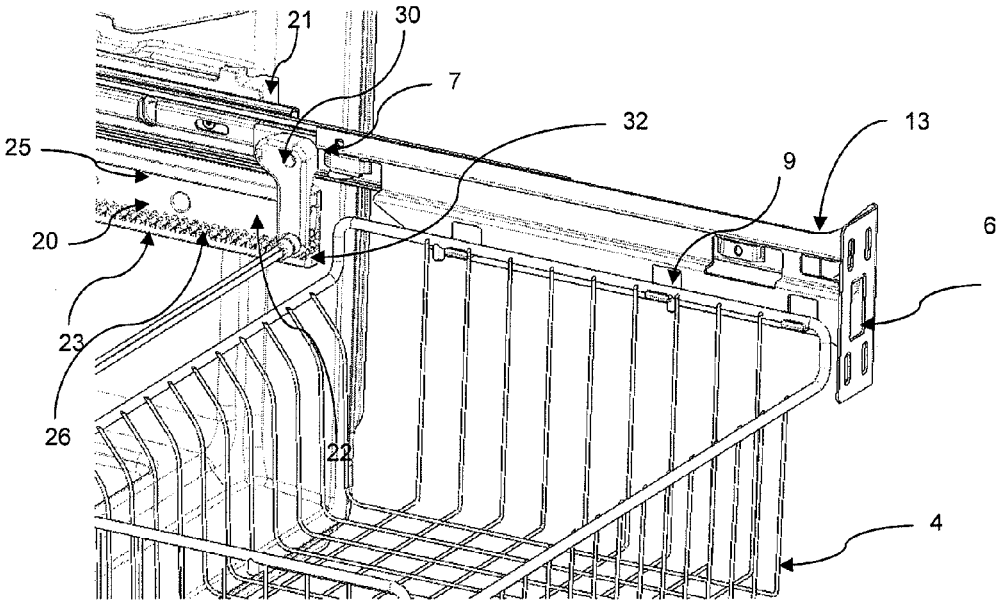
FIG. 4 is a detailed view of part of a rail and part of the drawer mechanism.

The rail (3) has two main parts, the first part, which is a mobile vehicle (11) is embedded within the second part, which is a fixed part (12). The fixed part (12) is fastened to the support beam (20) by means of fastening means (101), and at the same time, said support beam (20) is fastened to the wall (10). Specifically, in FIG. 4, the basket (4) projections (9) may be seen. The door (5), as stated above, is fastened to the front end (6) of the rail (3) mobile vehicle (11) by means of a supporting part, bracket, support or similar mechanism (13). The support (13) may contain fastening means, such as may be screws and nuts, which are capable of sustaining the door as well as the straightening mechanisms of the door (5). In the back end (7) of the rail (3) mobile vehicle (11), an alignment mechanism (30) may be found.

As will be analyzed with greater details in the following paragraphs, the support beam (20) has two main parts: an upper part (21) and a lower part (22). The upper part (21) of the support beam (20), is the part that will fasten the rail (3) by means of fastening means (101). The lower part (22) of said support beam (20) has three different walls, wherein a lower wall (23) has a rack (26) through which a pinion (32) of the alignment mechanism (30) will run.

Figure 5:
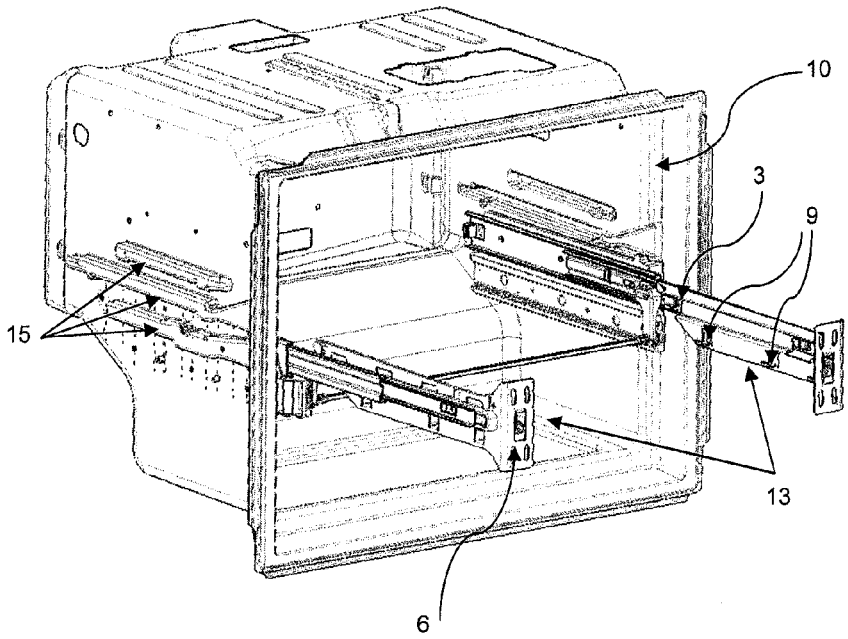
FIG. 5 is a perspective view of the drawer mechanism in a compartment.

In view of the type of projections (9), specifically designed, however not limited to, the application of a refrigerator, the basket (4) as will be shown in FIG. 5, may be removed. For example in a dish washing machine it is preferred that the basket (4) is not removable, and therefore, the projections (9) have to be fixed to said basket (4) with the rail (3).

The rail (3) front end (6) of the support (13), has a plurality of openings through which the fastening means will pass to support the door (5) with said front end (6). It should be noted that in the proposed design of the present invention, the supports (13) that are fastened to the rail (3) mobile vehicle (11), may be removed from the mobile vehicle (11) along with the door (5) which is disposed over the front face (6) of said supports (13), so to convey flexibility to the assembly, as well as easiness at the time of providing service or cleaning to the interior of the freezer or cabinet that has this novel system object of the present invention.

It is usual that the liner or wall (10) may contain a plurality of grooves (15). The previous art shows that the drawer mechanism lies over said grooves (15), contrary to that required by the present invention.

Figure 6:
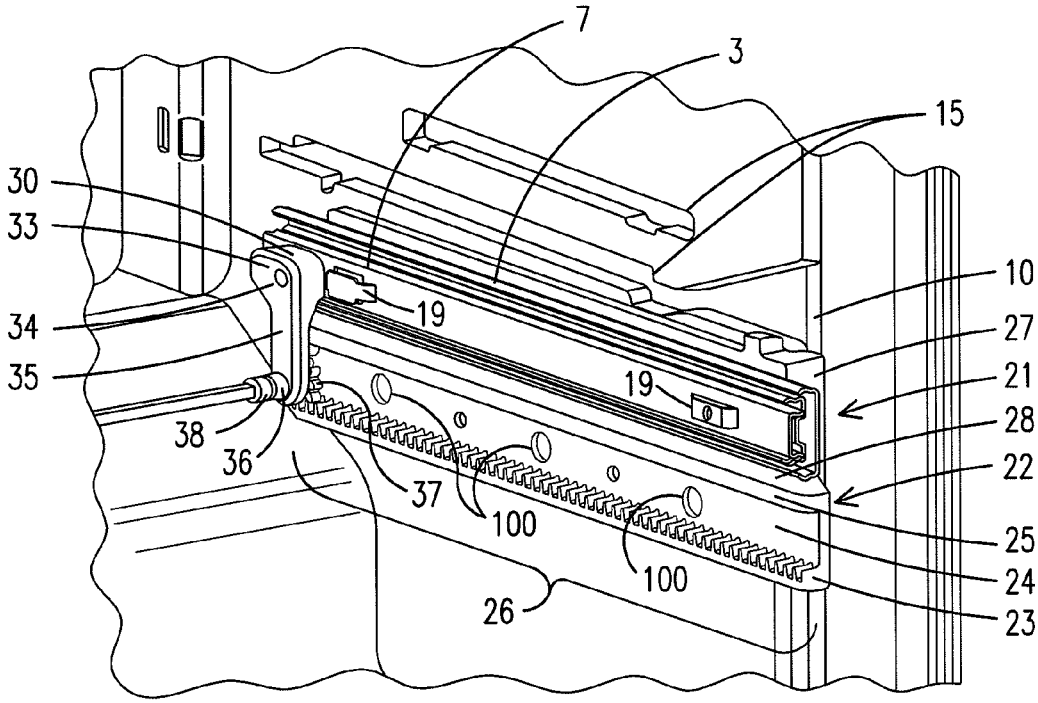
FIG. 6 is a conventional perspective view of the drawer mechanism in an introduced position.

In FIG. 6, said grooves (15) in the liner or wall (10) may be seen with greater precision.

The upper part (21) wherein the rail (3) will be fasted, contains a lateral wall (27) and a lower wall (28), whereas the lower part (22) contains a lower wall (23), a lateral wall (24) and an upper wall (25).

The upper part (21) is substantially smooth in its two walls—lateral and lower (27, 28)—which are substantially orthogonal between themselves. In the upper part (21) lateral wall (27) a rail (3) will be fastened by means of said fastening means (101). The upper part (21) lower wall (28) corresponds to the lower part (22) upper wall (25). It is noted, that the rail (3) does not rest over the upper part (21) lower wall (28), being one of the objects of the present invention, not to relate in any manner, said rail (3) with said upper part (21) lower wall (28), that is, the rail (3) lower part is not made to have contact with the upper part (21) lower wall (28). Should contact be made, it would incur in an undesired deterioration of the wall (10) or liner. The upper part (21) has a determined width, which should not be greater than the fastening means (101) that will fasten the support beam (20) with the wall (10) or liner. Also, the width of the upper part (21) lateral wall (27) and consequently, the lower part (22) lateral wall (24), may or may not be wider in the back part than in the front, so as to adapt to tapered walls (10) or liners.

The lower part (22) has three walls: an upper wall (25) that is the lower part of the upper part (21) lower wall (28), that is, the lower part (22) upper wall is the opposed face of the upper part (21) lower wall (28); a lateral wall (24) that is substantially orthogonal to the upper wall (25); and a lower wall (23) that is parallel to the upper wall (25) and consequently orthogonal to the lateral wall (24). The upper wall (25) is substantially smooth so that an alignment mechanism (30) projection (39) has little friction in case there is contact with the upper wall (25), as well, said projection (39) avoids that the pinion (32) gets away from the rack (26), thus avoiding that these two loose contact, thus resulting in a correct engagement at all times. Throughout the lateral wall (24) a plurality of different diameter sized barrels (100) are found; the greater diameter sized barrels (100) are provided in their circular face located in the rear, a passing opening (50) whose center coincides with the symmetry axis of the greater sized barrel (100), and it is through this passing opening (50) in which a fastener is passed, which may be preferably a screw or rivet which may be anchored to the wall (10); the lesser diameter sized barrels (47) also have in their rear a passing opening, this in a preferred embodiment, allows housing the chords of a screw or fastening means (101) with which the rail (3) will be fastened to the beam support (20) upper part (21). In the back part of said support beam (20) locators (29) may be found, that will be inserted to similar sized openings in the wall or liner (10), facilitating thus, the assembly mechanism for the drawers as will be explained below.

Figure 10:
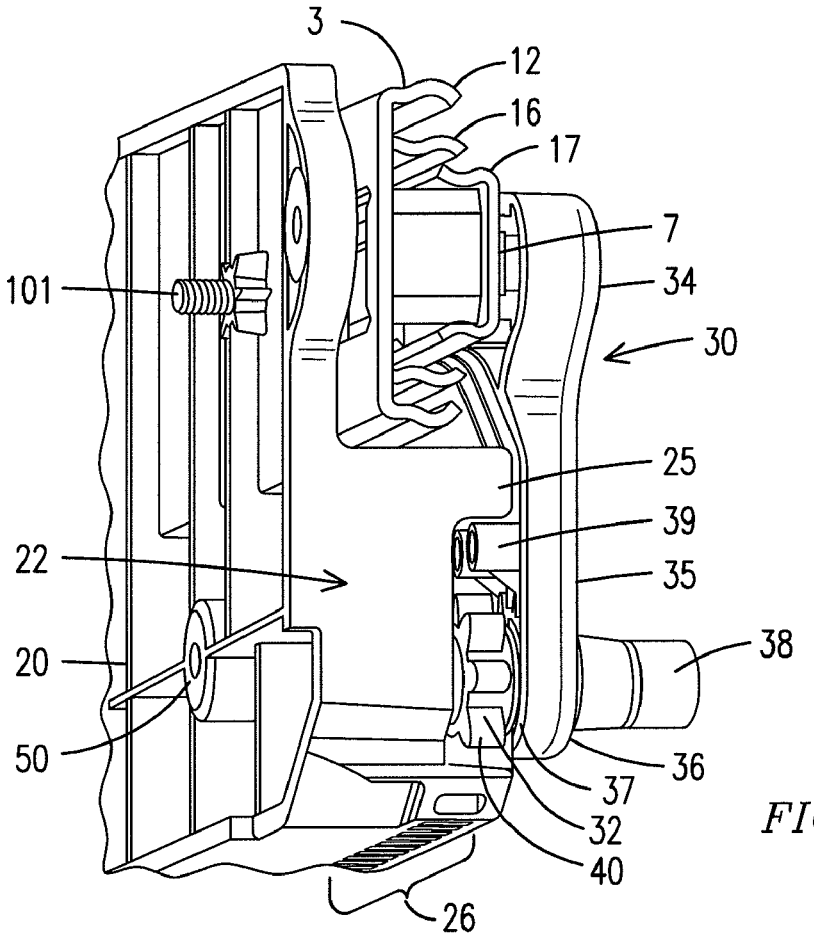
FIG. 10 is a back view in lateral perspective of the drawer mechanism in an introduced position.

The alignment mechanism (30) illustrated in FIG. 10, is made up of an upper part (34) and a lower part (35). The alignment mechanism in is upper part (34), is fastened to the back end (7) of the rail (3) mobile vehicle (11), specifically to the back end of the end section (12) of the mobile vehicle (11). The fastening of the alignment device (30) to the rail (3) mobile vehicle (11) may be through means of pin, screws, rivets, fasteners or any other fastening means (33) (not illustrated) further to having a resilient fastener (51). In view that the alignment mechanism (30) in its upper part (34) is fixed to the rail (3) mobile vehicle (11), when the rail slides in a horizontal axis, the alignment mechanism (30) will also be sliding in the same horizontal axis in a synchronous manner. On the other hand, the alignment mechanism (30) in its lower part (35) comprises a pinion (32) fastened by a pin (46) or introduced in the same alignment mechanism (30) having a first face (36), in which in its lower part houses a receiving cavity of the pinion (32) formed by the pin (46).

Figure 7:
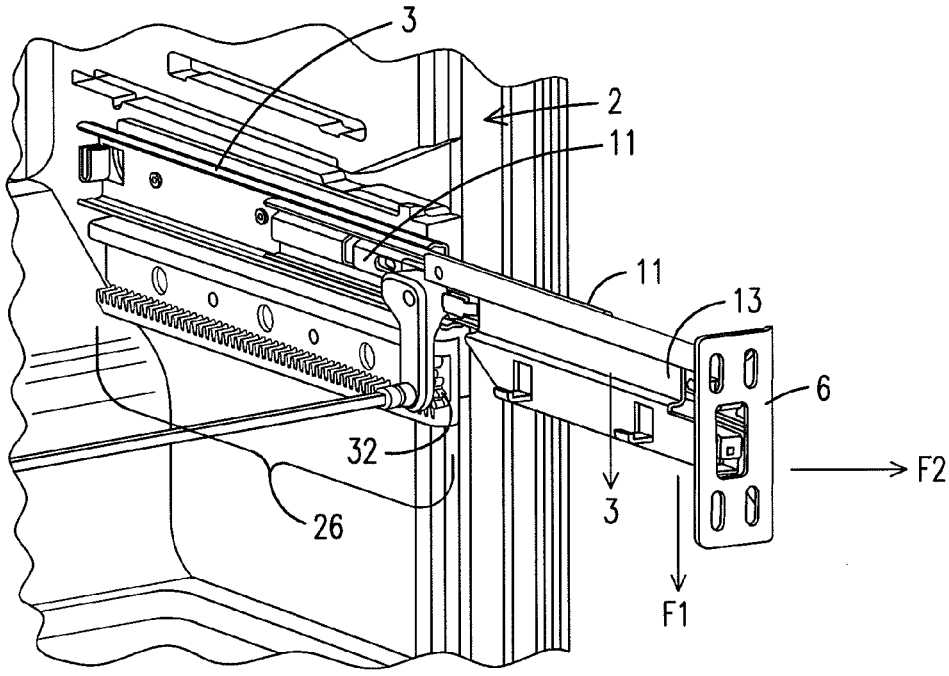
FIG. 7 is a perspective view of the drawer mechanism in an extracted position.

The pinion (32) is capable of rotating throughout the rack (26) such as is seen in FIG. 7. Being in a closed position, when pulling the handle (8) or by means of a motor (60) (not illustrated) coupled by a mechanism (61) to the rod (31) or receiving end (38), in the door (5) or bottom compartment (2), the user or motor (60) produce a horizontal axis force contrary to the force generated by the rail and possibly, depending on the apparatus, a magnet creating a seal between the door (5) and the apparatus.

Figure 8:
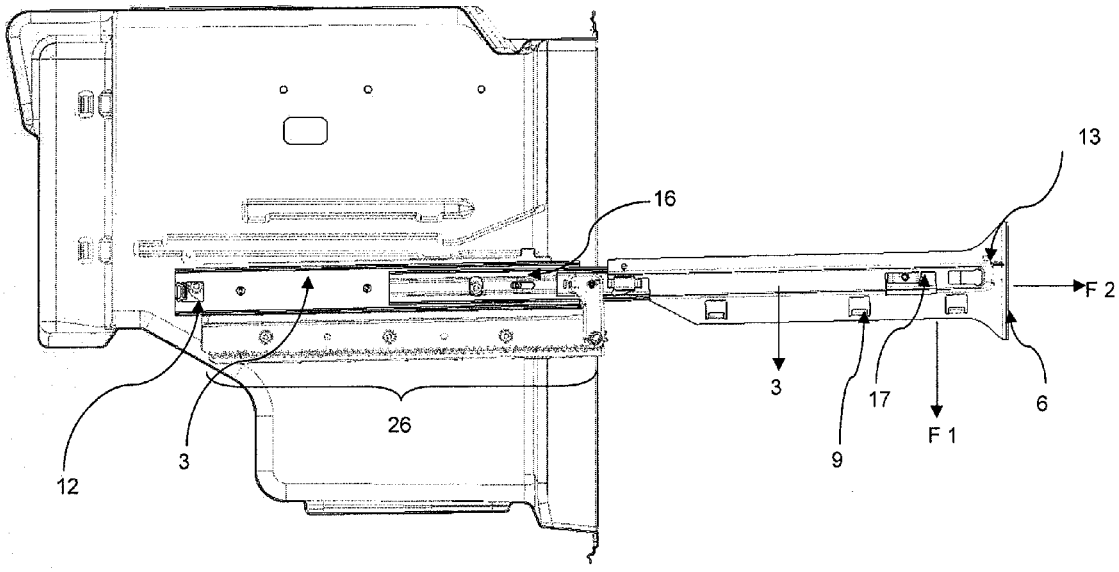
FIG. 8 is a cross-sectional view of a compartment where the drawer mechanism is in an extracted position.

When the rail (3) mobile vehicle (11) starts its extraction telescopic race, a downwards work (W) starts to be created, as may be seen in FIG. 8, in view of the basket (4) weight and the distance ($D_1$) ran by the rail (3) mobile vehicle (11). In view of the force generated by the user ($F_2$) that pulls on the handle, the distance ($D_1$) run by the rail (3) mobile vehicle (11) and particularly the weight force ($F_1$) of the lower compartment (2), the generated work (W) is in an essentially perpendicular direction to the force generated by the user ($F_2$), since the basket (4) weight force ($F_1$), in general, will be greater than the force generated by the user ($F_2$). Clearly the greater the distance ($D_1$) that the rail (3) mobile vehicle (11) runs, the greater work (W) is generated.

Figure 9:
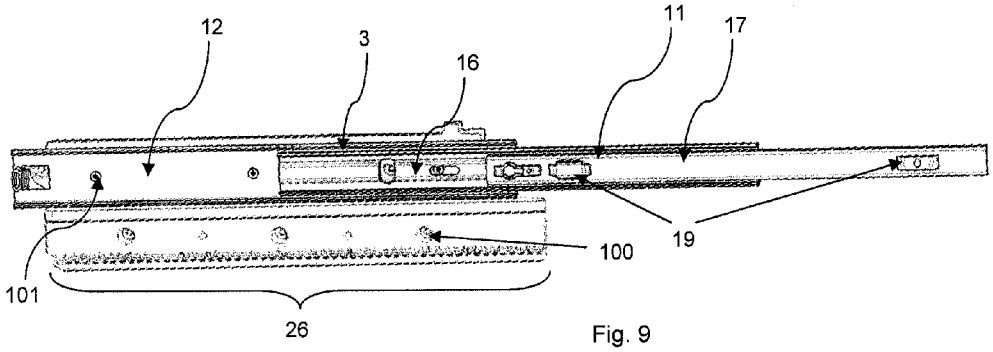
FIG. 9 is a right lateral view of the drawer mechanism in an extracted position.

The rail (3) is made up essentially by a end section (12) which is the part that will be fixed to the beam support (20) upper part (21), wherein the end section (12) is fastened by fastening means (101) to said upper part (21), and by a mobile vehicle (11), and thus, the telescopic rail (3) includes a end section (12), an intermediate section (16) and a mobile vehicle (11); to said mobile vehicle (11) a support (13) is attached, that contains projections (9) to sustain the basket (4). Each one of the rail (3) mobile vehicle (11) and end section (12) parts, has a longitudinal length ($L_1$, $L_2$, $L_3$) and arms ($B_1$, $B_2$, $B_3$), such as is observed in FIG. 9. In an introduced position, the intermediate section (16) is embedded within the end section (12), whereas the mobile vehicle (11) is embedded within the intermediate section (16). The rail (3) parts (12, 16, 17) are connected in a slidable manner between themselves.

When starting the extraction means race of the telescopic rail (3), the embedded parts (16, 11) are un-housed. That is, when the user pulls the handle (8), the mobile vehicle (11) starts a race in a horizontal axis in a determined direction, which is outwards of the lower compartment (2). The mobile vehicle (11) will run the length of the final arm ($B_3$) in a sliding manner with regards to the intermediate section (16) housing said mobile vehicle (11), before finding a stop that prevents that said mobile vehicle (11) runs the total of its length ($L_3$). This avoids a work excess (W) in view of the basket (4) weight force ($F_1$), which could cause the possible rupture of the rail (3). When the race of the mobile vehicle (11) ends, the race in the horizontal axis of the intermediate section (16) mobile vehicle (11) starts. The intermediate section (16) will run the length of the intermediate arm (B2) in a sliding manner with regards to the end section (12) that houses said intermediate section (16), before finding a stop that prevents said intermediate section (16) to run the entire length (L2), in view of the same reasons above explained. Therefore, the distance ($D_1$) ran by the telescopic rail (3) is the same than the arm (B3) of the mobile vehicle (11), plus the arm (B2) of the intermediate section (16), being this, substantially the same than the length (L1) of the end section (12). Clearly, length (L1) of the fixed part (12) depends on the deepness of the lower compartment (2), and therefore, the longitude of all the mechanism depends on the deepness of said lower compartment (2).

The rail (3) used in the present invention, may be of the type of sliding parts, or, the type that uses ball bearings (not shown).

FIG. 10 shows a preferred embodiment of the present invention. Specifically, the rear end of the support beam (20) is shown. The rear end of said support beam (20) is substantially smooth and hollow. It is hollow so as to save material and smooth to couple the drawer mechanism to any type of wall (10). In the figure, a fastening means (101) may be seen, that is capable of going through the rail (3) final section (12) and the support beam (20) and of sustaining, in part, the drawer mechanism of the present invention in a determined wall (10). Preferably, as shown in the following paragraphs, there is more than one means to distribute the basket (4) weight and its content throughout the support beam (20).

The alignment mechanism (30) in its upper part (34), is fixed to the back end (7) of the rail (3) mobile vehicle (11). The fastening of the alignment device (30) to the end section (12) may be by means of pins (33) or fasteners. In the lower part (35) of the alignment mechanism (30), a receiving end (38) is found in the first face (36) and the pinion (32) and projection (39) in the second face (37). The alignment mechanism (30) projection (39) is in contact with the upper wall (25) of the support beam (20) lower part (22) causing friction among the parts.

In the alignment mechanism (30) lower part (35), the pinion (32) teeth (40) engage with the valleys (41) and crests (42) of the rack (26). Therefore, the alignment mechanism (30) lower part (35) is fastened to the support beam (20) lower part (22) in view of the contact between the projection (39) with the upper wall (25) and the pinion (26) and its teeth (40) with the valleys (41) and crests (42) of the rack (26). This disposition results in advantageous, in view that the rack (26) helps supporting sudden or torsional weights that the drawer could suffer in a determined moment, so these forces, that would be reflected in the rails (3), will be transmitted to the alignment device reflecting this force in the pinion (32), this, at the same time, transferring to the rack (26), transferring thus, the resulting effort to the wall (10); a correct working of said mechanism may also be achieved, if the rack is relocated (26). That is, in a diverse embodiment, the rack (26) is placed in the lower wall (23) lower face; for this, a greater distance between the projection (39) and the pinion (32) crest is necessary, said distance should be a greater than the width of the lower wall (23), being such that it allows the correct engagement between the pinion (32) and rack (26), and thus the projection (39) will slide over the upper face of the lower wall (25), forming thus along with the pinion (32) a "C" that will run throughout the lower wall (23), over the upper and lower faces. A diverse mechanism for an alternate embodiment of the invention may be seen in the relocation of the rack (26), which, would be disposed in the upper wall (25) instead of the lower wall (23) as is the case of the preferred embodiment of the invention, the rack (26) being disposed in the upper wall (25) lower face, and therefore, the pinion (32) would be disposed in the lower part of the alignment mechanism (30), existing a distance between the crest of the pinion's (32) teeth, and the projection (39), similar to the width of the upper wall, being the first greater than the second; thus, the pinion would not lose its engagement distance with the rack (26), since it should be taken into account that the projection (39) would be near or touching (depending on the mechanical restrictions of the design), the upper wall (25) upper face, forming a "C" over the rack (26) and the upper wall (25), working these two last as a guide. Another embodiment is placing the rack (26) over the upper wall (25) upper face, and thus, the rack (32) is located above the projection (39), keeping a distance between themselves, similar to the width of the upper wall (25), which, as in the prior embodiment, this arrangement allows a correct engagement between the pinion (32) and the rack (26), thus forming the projection (39) along with the pinion (26) a "C" that runs over the rack (26) as well as the lower face of the upper wall (25).

When the user pulls the handle (8) creating an outwards force with regards to the compartment (2), and when fixing the alignment device (30) to the mobile vehicle (11), said alignment device (30) starts to run the same race than the mobile vehicle (11). When fastened the alignment mechanism (30) lower part (35) with the support beam (20) lower part (22), and when running the same race than the rear end of the mobile vehicle (11), the alignment mechanism (30) lower part (35) cannot be loosened.

In another preferred embodiment, the projection may be made up of a small wheel or bearing that rotates over an axis, diminishing the friction created between the wall, be this the lower part (22) upper wall (25) or the opposed face of the lower part (22) lower wall (23) and the projection (39).

Figure 11:
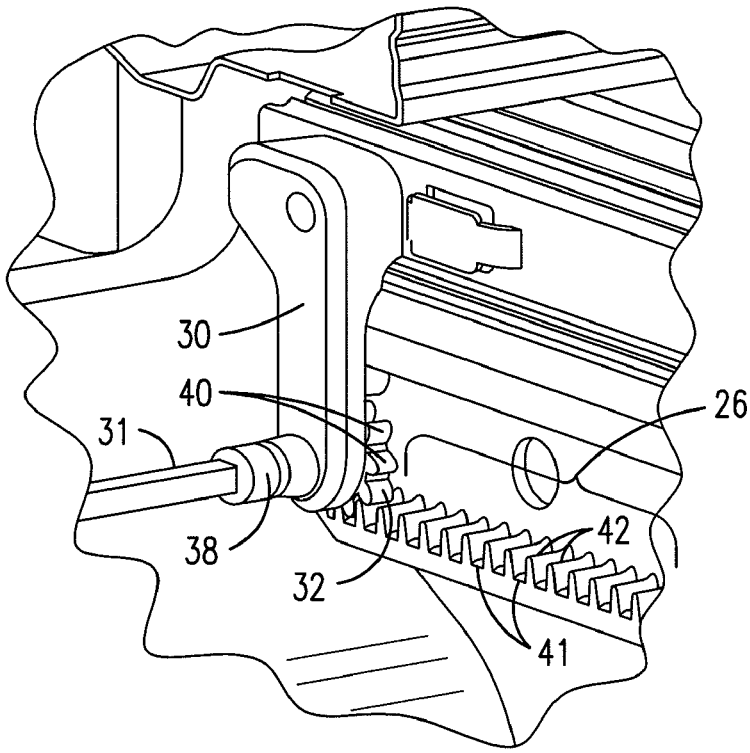
FIG. 11 is a detailed upper perspective view of the parallel mechanism with a rail and a mechanism to fasten the rail.

Having the pinion (32) and rack (26) in the drawer mechanism, allows a smooth race when extracting the lower compartment (2). Furthermore, the rod (31), as seen in FIG. 11, connects the first alignment mechanism (30) with an opposed second alignment mechanism (30') by means of the receiving ends (38), allowing the race of the lower compartment (2) to be equal, since when generating traction from one side, the same traction will be generated in the opposing side. Therefore, when generating force, be it extraction or introduction, the user will feel a soft, synchronic and equal race on both sides of the lower compartment (2), that does not allow the lower compartment to get stuck during its extraction or introduction race.

The pinion (32) and rack (26) are designed in such a manner that engage between themselves. That is, the teeth of the pinion (32) has a width and length such that, that concurs with the deepness and width of the rack (26) valleys (41). Likewise, the radial distance between each one of the pinion (26) teeth (40) have a radial distance such, that concur with the width and height of each one of the crests (42). Therefore, the engagement between the pinion (32) and rack (26) is precise and soft.

Figure 12:
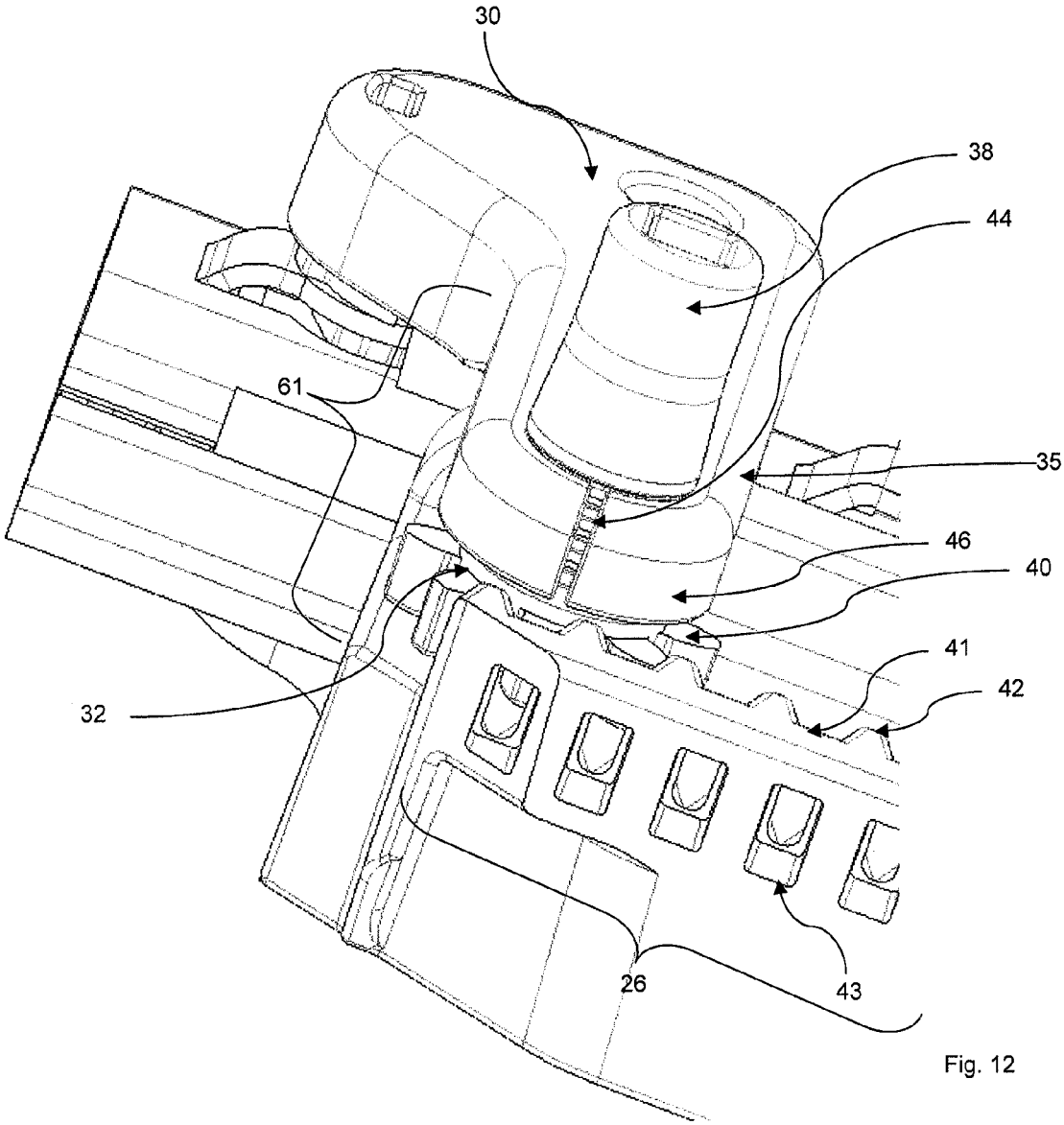
FIG. 12 is a back perspective view of the parallel mechanism, showing an example structural relation of this rail and the rail fastening mechanism.

In each one of the rack (26) valleys (41), an opening (43) may be found as shown in FIG. 12. In the exemplary case of a freezer, if a liquid or solid is spilt, the opening (43) does not allow said liquid or solid to remain stuck in said rack (26) valley (41). In the exemplary case of an oven, if a liquid or solid is spilt, the opening (43) does not allow the liquid or solid to carbonize in the rack (41) valley (41). In the exemplary case of a dish washing machine in which liquid is constantly spilt, the opening (43) does not allow liquid to stagnate in the rack (26) valley (41). If liquids or solids stagnate or carbonize in the valley (41), it is likely that the race of the drawer does not feel smooth.

In the alignment mechanism (30) lower part (35), as shown in FIG. 12, said alignment mechanism (30) comprises a pin (46) that embraces the internal part (44) of the pinion (32). So that the receiving end (38) rotates in view of the pinion (32) and rack (26), the receiving end (38), the pinion (32) and internal part (44) have to be the same piece, the internal part being located between the receiving end (38) and the pinion (32). The above-mentioned set of pieces, will be called from here-on-forth rotating mechanism (61). So that the rotating mechanism (61) rotates with regards to the traction generated by the race of the pinion (32) and its teeth (40) with the rack (26) and its valleys (41) and crests (42), the rotating mechanism in its internal part (44) has to have the least contact possible, and consequently, the minimum possible friction with the pin (46). Therefore, as seen below, the rotating mechanism (61) internal part (44) has a plurality of grooves, wherein the groove valleys are substantially greater in length than the crests, so as to reduce friction between the crests and the rotating mechanism (61) receiving opening. The pin (46) engages without the possibility of releasing the rotating mechanism, since the pinion is introduced by the rear part of the alignment mechanism, inserting first its thinnest part corresponding to the receiving end (38), followed by a conically broadening of its stem, located proximal its greatest diameter to the internal part (44), thus allowing an easy introduction of the pinion (32) within the opening provided by the pin (46), opening in a resilient manner to allow the entry of the already disclosed conically broadened stem of the pinion (32), ending the introduction of said stem in the opening, the pin (46) returns to its resting position.

Figure 13:
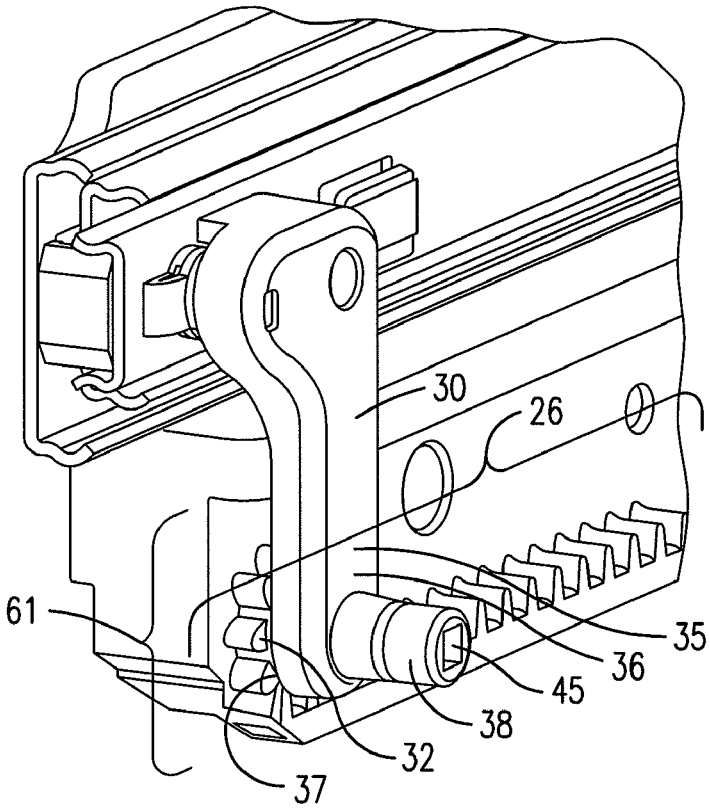
FIG. 13 is a cross-section of a compartment with the rail fastening mechanism.

Furthermore, the internal part (44) has to have a greater length than the width of the alignment mechanism (30) lower part (35), so that the receiving end (38) does not have contact with the alignment mechanism (30) first face (36) and so that the pinion (32) does not have contact with the alignment mechanism (30) second face (37), while the pinion (32) and the receiving end (38) rotate simultaneously, as may be seen in FIG. 13, so that these parts do not have friction among themselves.

The receiving end (38) has a groove (45) that has the same geometry that the rod (31) transversal section. The rod (31) may be any transversal section shape as long as it has at least one secant, groove, opening, stop, ratchet, or any other type of device that correctly grasps the rod (31) within the groove (45), preventing relative movement between the rod (31) and groove (45), so as to privilege the correct torque transmission between the pinion (32) and rod (31). A first end of the rod (31) is inserted in the groove (45) of a first alignment mechanism (30), whereas a second end of the rod (31) is inserted in the groove (45) of the second alignment mechanism (30') opposed to the first alignment mechanism (30).

Since the pinion (32) and the receiving end (38) form part of the same rotating mechanism (61) bonded by the internal part (44), when creating traction the pinion (32) with the rack (26), the rod (31) is consequently rotated. In reference to FIGS. 11 and 13, when rotating the rod (31), the opposed second alignment mechanism (30') receiving end (38) is rotated. Consequently, if the user pulls or pushes on one end of the handle (8) only, an equivalent traction and force is generated in both drawer mechanisms of the present invention.

Figure 15:
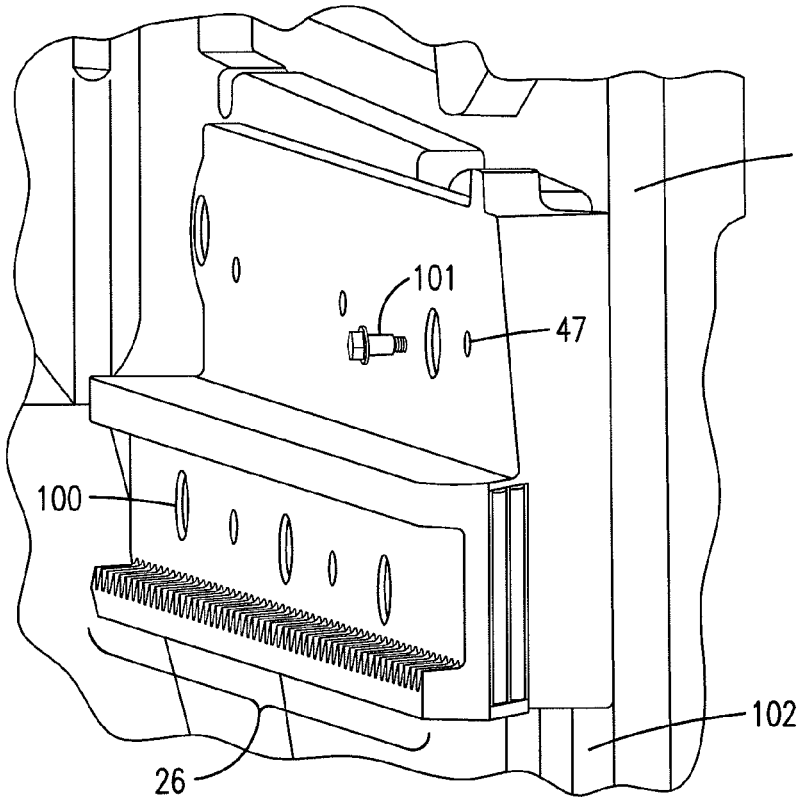
FIG. 15 is a back view of the rail fastening mechanism.
Figure 14:
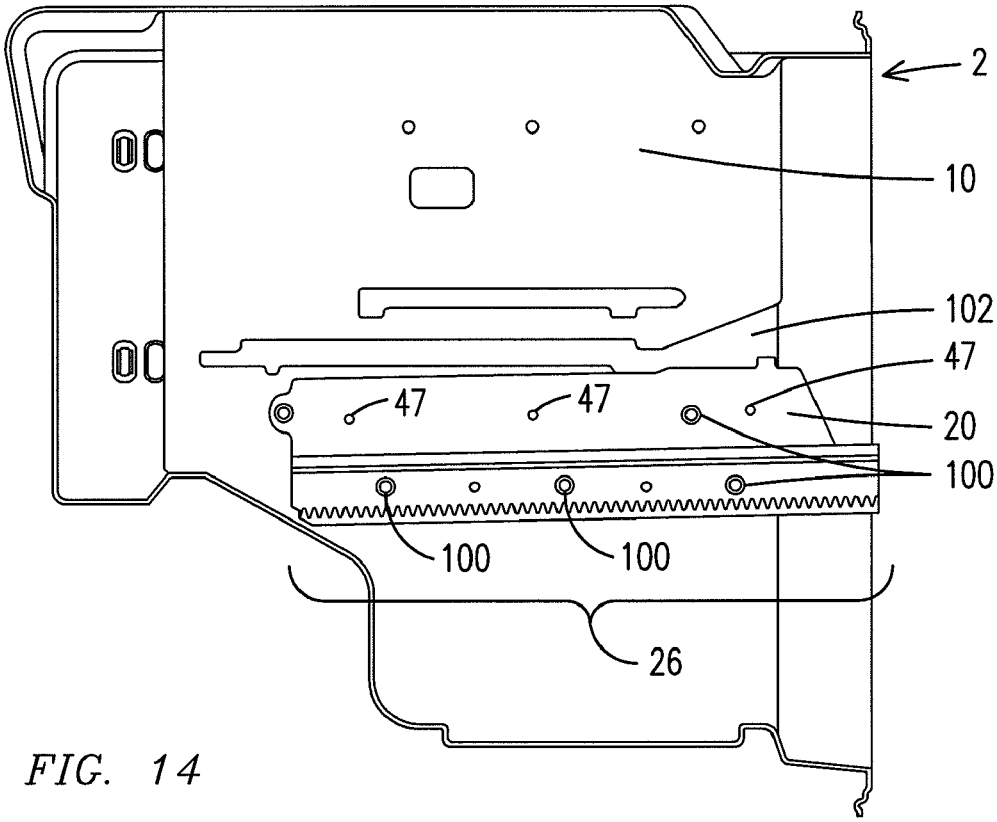
FIG. 14 is a frontal perspective view of the fastening mechanism to fasten the rail attached to a wall.

In FIGS. 14 and 15 the fastening means (101) may be seen, that fasten the support beam (20) with the compartment (2) wall (10). Preferably, at least two fastening means (101) are present in the support beam (20), in each one of the greater sized barrels (100). In one embodiment, as shown in the following figures, the rear part of the support beam (20) is substantially flat. In another embodiment, as is shown in the following figures, the rear part of the support beam (20) has a lug (49) for each fastening mean (101), and the rest of the rear part is substantially flat. Finally, in another embodiment, the rear part of the support beam (20) may or may not have lugs (49) for each fastening means (101), however, has a curvature or a lateral front wall (48) in the support beam (20) front end (48). In this last embodiment, the front lateral wall (48) concurs with the curvature (102) of the apparatus wall (10) or liner. It is usual in refrigerators, ovens, washing machines, washing machines lower drawers, which are located in the washing machine lower part or are in form of small drawers over which the washing machine is mounted, so as to house different articles, washing machines and further home appliances, that the lateral wall (10), in its front part, that is, in the part proximal to the opening, has a curvature (102) towards the apparatus lateral end. Therefore, this curvature may be available in the mechanism front end so as to position the drawer mechanism, so that said support beam (20) is quickly positioned to said wall (10), being that the curvature in both is used as a reference guide. In this embodiment the rest of the rear part may be or not flat, depending on whether it has lugs (49).

FIG. 15, shows an embodiment that does not have the front lateral wall (48) to position the drawer mechanism to the curvature (102) shown in the wall (10). Furthermore a fastening means (101) coupled to the smaller diameter sized barrels (47) provided by the support beam (20) upper part (21) is shown.

FIGS. 16 and 17, show a back and front view, respectively, of the third embodiment mentioned for FIG. 14. Specifically, the support beam (20) is shown with a lateral front wall (48) that has a greater width than the support beam (20) width. As mentioned before, this front lateral wall (48) that is generally perpendicular to the rest of the support beam (20), has a curvature similar to the curvatures (102) (illustrated in FIG. 18) usually used in home appliances walls (10). Therefore, the front lateral wall (48) and the curvature (102), define the deepness, to quickly assembly and couple the drawer mechanism of the present invention with the home appliance wall (10). Clearly, if it is not a home appliance, the front lateral wall (48) may be eliminated from the drawer mechanism.

Specifically, making reference to the back view of FIG. 16, locaters are shown (29). Preferably, more than one locater (29) in each one of the drawer mechanisms may be found. The locaters (29) allow, as does the front lateral wall (48) a quick assembly and coupling of the drawer mechanism of the present invention with the wall (10). Specifically, the wall (10) has the same number of openings than the drawer mechanism locators (29). Therefore, when assembling the drawer mechanism of the present invention with the wall, the locater (29) has to be centered with its corresponding opening in the wall (10). When centered the drawer mechanism locater (29) with the wall (10), the locater (29) mechanism is inserted in the wall (10) opening. Once the locater (29) mechanism is inserted in the wall (10) opening, the drawer mechanism is able to sustain itself with the wall (10) by means of the inserted locaters (29) in the wall (10) openings, and therefore, the fastening means (101) may be inserted without holding the drawer mechanism. Furthermore, the locaters (29) are located in such a manner throughout the support beam (20) rear part, that they coincide with the wall (10) openings that will house the fastening means (101).

As will be seen in FIGS. 16 and 17, the support beam (20) upper part (21) is plunged with regards to the support beam (20) lower part (22). This, so that the upper part (21) may sustain the rail (3) as well as the alignment device (30), so that when finally both are sustained, said upper part (21), the rail (3) and the alignment device have a similar width to the lower part (22).

Additionally, it is seen that the lower part (22), the upper wall (25), the lateral wall (27) and the lower wall (28), form a type of groove or "C" profile, through which the alignment mechanism (30) will perform its race.

In the embodiment of FIG. 16, a lug (49) is seen, which is useful to improve adaptability to home appliances, in view of the wall (10) or liner grooves (15) of the apparatus. It is noted that the lug (49) is not there so that it rests on the apparatus wall (10) or liner, rather to protect, in part the fastening means (101) and on the other part, so that the fastening means (101) may be quickly inserted.

FIG. 18, shows the two possible embodiments of the above. That is, a lug (49) in the support beam (20) lesser diameter sized barrel (47) is shown; whereas the other lesser diameter sized barrels (47) have no lugs (49). Said lug (49) and the front lateral wall (48) are specifically useful to facilitate the mount in home appliances. However, it is preferred that an ordinary drawer that will be mounted to a flat wall (10), lacks lugs (49) and a front lateral wall (48) since they would not allow a proximal assembly to the wall.

As stated before, another element that facilitates the assembly of the drawer mechanism of the present invention, are the locaters (29). The locaters (29) allow not having the front lateral wall (48) and lugs (49). Specifically, at least two openings are made in the wall (10) previous to mounting, with a distance between said openings similar to the distance between the locaters (29). Likewise, the wall (10) openings are, as are the locaters (29), in the same vertical axis. When mounting the drawer mechanism in the wall, the wall (10) openings should be found and the locaters (29) should be inserted in said openings, wherein the wall (10) openings and locaters (29) demark the horizontal and vertical axis mounting for drawers.

The locaters (29) may or may not carry load from the drawer mechanism. That is, the locaters (29) may help distribute the drawer load weight and even, in an alternate embodiment of the present invention, may be omitted.

However, it is the fastening means (101) which carry the greatest drawer load weight, and the ones that effectively distribute the drawer load weight, given that the load received by the rails, is transmitted via the fastening means (101) and the lesser diameter sized barrels (47) to the support beam (20) upper part (21), the force transmission flows from the wall (10), by means of the greater diameter sized barrels (100) and the passing opening (50), which transfer the resulting force by means of the fastening means (101) which will be anchored to the wall (10); therefore, the drawer mechanism of the present invention is capable of fastening to the wall (10), resisting the weight of the drawers (4) without defeating the wall (10) and distributing the weight equitably throughout the length and width of the support beam (20).

Figure 19:
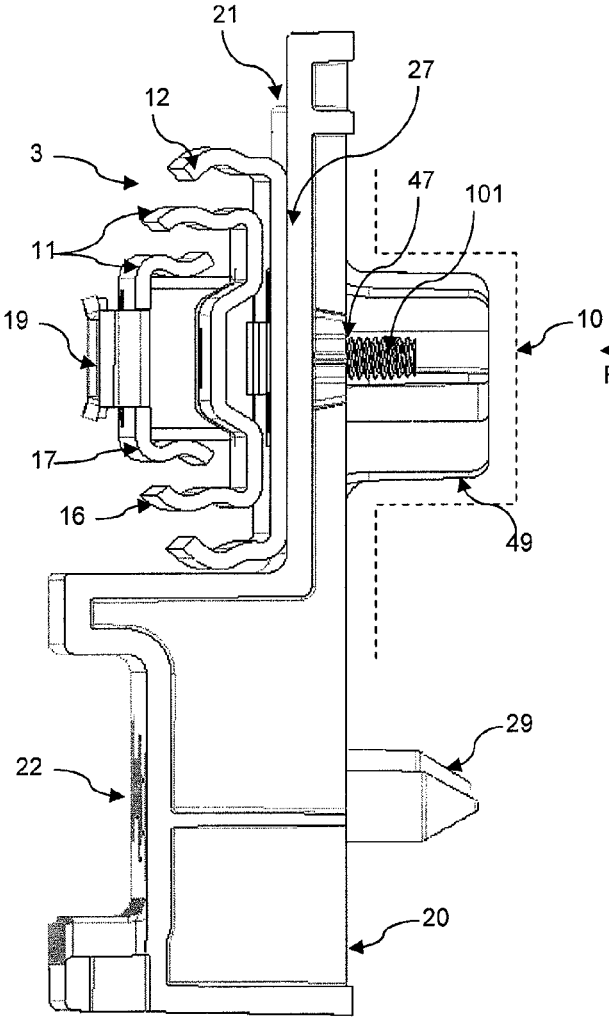
FIG. 19 is a cross-section view of another example embodiment of the drawer mechanism embodying aspects of the present invention.

As stated before, the rail (3) is made up of three main parts, as may be seen in the cross-section of FIG. 19. A fixed part (12), which is joined to the upper part (21) lateral wall (27) by means of fastening means (101), contains an opening in the same axis than the smaller sized diameter barrels (47) of the upper part (21) lateral wall (27). A mobile vehicle (11) that is mechanically joined, allows the longitudinal displacement by an intermediate section (16) embedded within the fixed part (12). The mobile vehicle (11) has at least two fasteners (19) to sustain the support (13), said support (13) has projections (9) to sustain the basket (4). The fasteners (19) may be in the ends of the mobile vehicle, and being able to be part of said mobile vehicle (11).

It is necessary to point out that in no part of the rail (3), specifically in the fixed part (12) of the rail (3), which is the outermost part of said rail (3), does it make contact and consequently rest over the upper part (21) lower wall (28). In fact, as seen in FIG. 19, there is a gap between the fixed part (12) and the lower wall (28). It has been observed that resting the fixed part (12) over the lower wall (28) distributes erroneously the drawer (4) weight load, and ends up defeating the force generated by the drawer mechanism fastening means (101).

In a first embodiment with lug (49), the wall (10) has a groove, in which the lug (49) will be inserted. It is necessary to point out that it is not intended that the lug (49) should hold weight or distribute drawer (4) weight over the wall (10) groove. It is possible that the upper part (21) lateral wall (27) fastening means (101) have a length greater than the lug (49) to fasten to the wall (10) groove.

Figure 20:
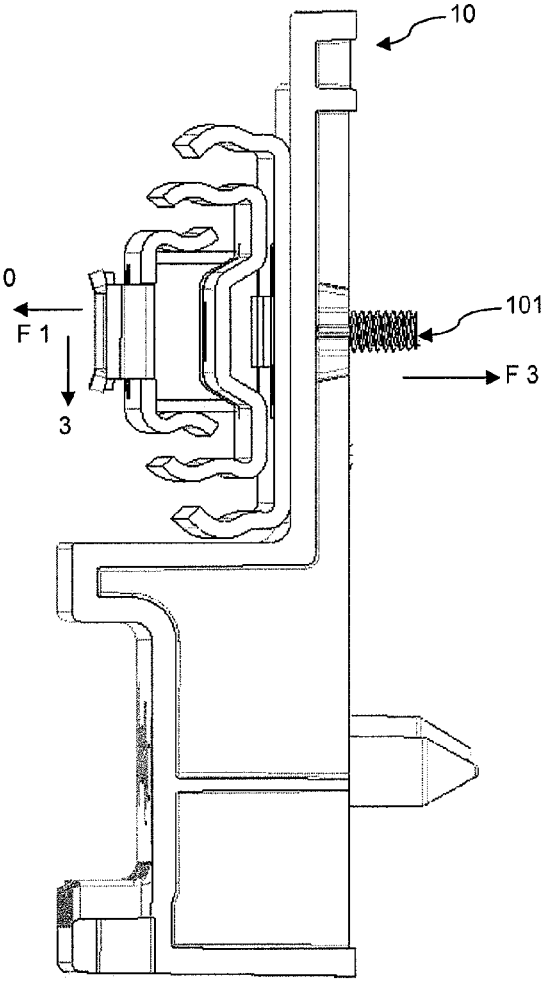
FIG. 20 is a view of a transversal cut of the drawer mechanism.

In a second embodiment without groove (49), as shown in FIG. 20, the drawer mechanism is adaptable to any type of wall (10), independent of whether it has grooves or not. Therefore, in this embodiment, the fastening means (101) in the upper part (21) lateral wall (27) are capable of being inserted in the wall (10). Likewise, the fastening means (101) in the lower part (22) lateral wall (24) are also capable of being inserted in the wall (10). As stated before, it is possible that the locaters (29) rest on the wall, and consequently, also help distribute the drawer (4) weight.

The fastening means (101), be them of the lower part (22) lateral wall (24) and/or the upper part (21) lateral wall (27), possibly in combination with locaters (29), should make a contrary force ($F_3$) to the basket weight force ($F_1$) and the work (W) done by the rail (3) and basket (4), specifically the basket (4) and its content, be it when the basket (4) is introduced in the drawer or even more so, when the basket (4) is extracted.

Figure 21:
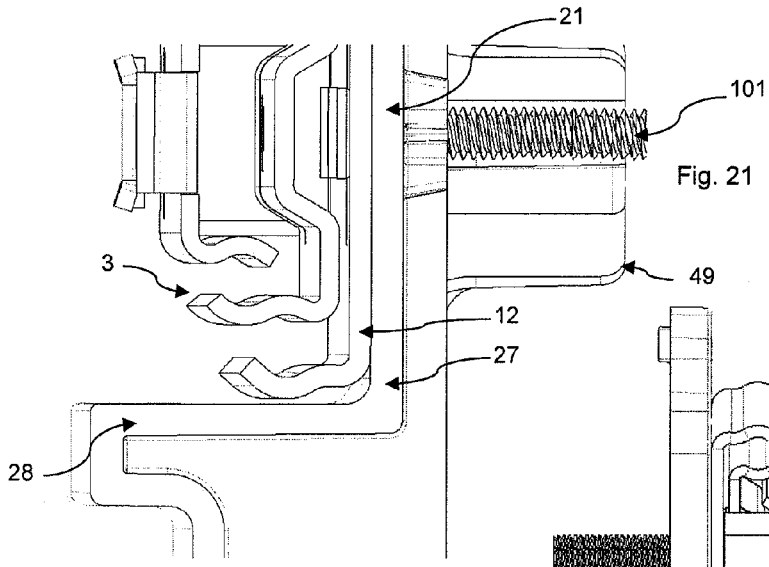
FIG. 21 is a back view of the drawer mechanism.

FIG. 21 is a detailed cross-section view of the intersection between the upper part (21) lateral wall (27) and the lower wall (28). Again, it is pointed out that there is a gap between the rail (3) fixed part (12) and the support beam (20) upper part (21) lower wall (28), therefore, the rail does not contact or rest over said lower wall (28). In the same figure it may be seen that the lower wall (27) is completely perpendicular to the upper part (21) lower wall (28).

In the same figure, a previously mentioned embodiment is shown, wherein the fastening means (101) has a greater length than the lug (49), and therefore, the drawer mechanism of the present invention is also capable of being fastened to the wall (10) groove in the support beam (20) upper part (21).

Figure 22:
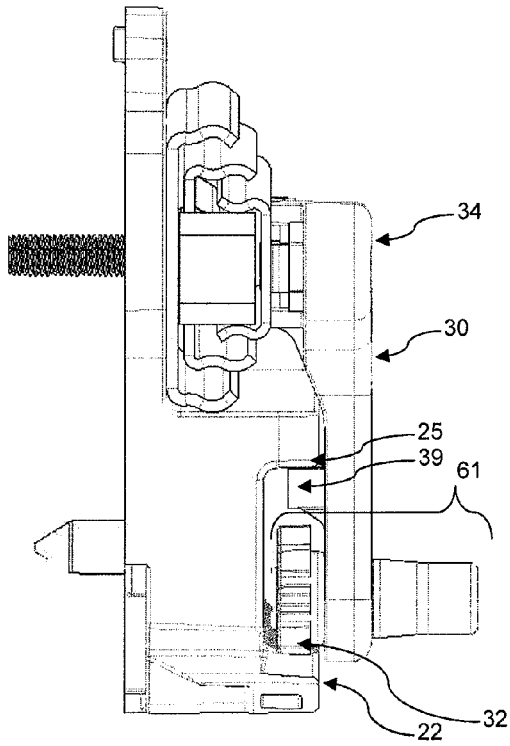
FIG. 22 is a perspective view of the parallel mechanism.

FIG. 22 shows yet a further embodiment, wherein there are no lugs (49) and a front lateral wall (48). In the same figure, an alignment mechanism (30) projection (39) is shown, which is in contact with the lower part (22) upper wall (25). The upper part of the projection (39) is preferably circular to reduce the friction between the projection (39) upper part and the upper wall (25). Likewise, the alignment mechanism (30) pinion (32), is in contact with the lower part (22) rack (26). Therefore, the projection (39) and rack (26) enclose in a horizontal axis the alignment mechanism (30) during its movement.

Figure 23:
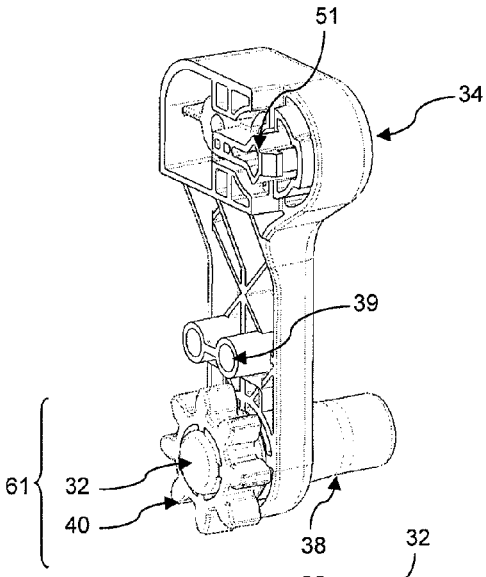
FIG. 23 is a lateral view of a pinion of the parallel mechanism.

Likewise, as may be appreciated in FIGS. 22 and 23, the alignment mechanism (30) upper rear part (34), has a resilient fastener (51) capable of fastening with the rail (3) mobile vehicle (11) back end. The distance between the projection (39) upper part and the part between each of the pinion (32) teeth (40), should be slightly less than the distance between the upper wall and the lower part (22) lower wall (23).

Figure 24:
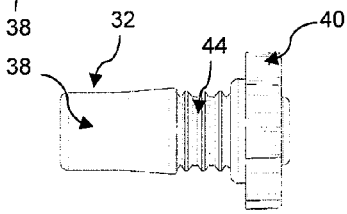
FIG. 24 is a lateral view of the pinion.

The pinion is preferably made of a single piece as seen in FIG. 24; comprising three parts, a receiving end (38), an internal part (44) and teeth (40). The internal part (44) has a plurality of grooves so as to diminish contact and consequently friction, existing between the opening inner contact surface formed by the alignment mechanism (30) lower part (35) fastener (46); the inner part (44) groove valleys may be preferably substantially lengthier than the crests, so that the fastener (46) engages without the possibility of releasing the pinion (32).

Alterations to the structure disclosed in the present invention, may be seen by those skilled in the field. However, it should be understood that the present invention relates to the preferred embodiments of the invention, which is for illustrative purposes only, and should not be construed as a limitation of the invention. All amendments that do not depart from the spirit of the invention are included within the body of the attached claims.

The invention claimed is:

1. A support beam system for mounting a drawer rail mechanism in a liner of a cabinet comprising:

an upper part defined by a side wall and a lower wall being substantially "L" shaped;

a lower part defined by a side wall, an upper wall and a lower wall being substantially "C" shaped; wherein said upper part and said lower part are integrally formed in one piece;

a rail fastened to the upper part;

an alignment mechanism having a first end and a second end, the first end being fastened to said rail, and the second end comprising fastening means;

a rack formed in the lower part, and a pinion rotatably coupled to the second end of said alignment mechanism by means of said fastening means, and adapted to be housed in said lower part in order to mesh with the rack.

2. The support beam system according to claim 1, wherein said rack comprises a plurality of valleys and a plurality of crests, wherein the valleys comprise an opening that allows free air flow or liquid flow to avoid accumulation of dirt.

3. Support beam according to claim 1, wherein over the alignment mechanism rack said pinion runs, and wherein said pinion in a receiving end houses a rod which transfers force or torque to another pinion disposed in the opposite end of said rod, so that the alignment mechanism may run synchronously.

4. The support beam system according to claim 1, wherein the lower part is defined by a lower wall having an upper face, a side wall and an upper wall having a lower face, wherein the rack is located in the upper face of the support beam lower part lower wall, the alignment mechanism having a protrusion between the first end and the second end, the protrusion adapted to slide abutting the lower face of the upper wall of the lower part.

5. The support beam system according to claim 1, wherein the rail comprising at least one mobile vehicle having two ends, wherein the first end of the alignment mechanism is fastened to one of the two ends of the mobile vehicle.

6. The support beam system according to claim 1, wherein the pinion comprises:

a receiving end having a first end and a second end, the second end having greater diameter than the first end, a middle part abutting the second end of the receiving end, and a meshing part abutting with the middle part, wherein the fastening means is a pin which has an opening through which the first end of the receiving end is inserted until the meshing part abuts with the second portion and until the opening surrounds, at least in part, the middle part, fastening thus the inner part of the pinion to the alignment mechanism;

wherein the middle part of said pinion has a plurality of grooves which diminish contact and friction between the pin and the fastening means; and wherein said receiving end houses a rod which transfers force or torque to a second pinion of a second support beam system in the opposite end of the cabinet liner.

7. The support beam system according to claim 1, wherein the support beam is fastened to the liner by means of barrels and fasteners, wherein at least one barrel protrudes from the other barrels for guiding the mounting of the support beam to the liner.

8. A home appliance comprising at least one support beam system according to claim 1.

9. A drawer rail assembly for mounting a drawer in a slidably manner in a cabinet, the cabinet comprising a first substantially vertical liner and a second substantially vertical liner; the drawer rail assembly comprising:

a first support beam system mounted in said first substantially vertical liner and a second support beam system mounted in said second substantially vertical liner, the first support beam system being substantially co-lineal with the second support beam system, each support beam system comprises:

an upper part defined by a side wall and a lower wall being substantially "L" shaped;

a lower part defined by a side wall, an upper wall and a lower wall being substantially "C" shaped; wherein said upper part and said lower part are integrally formed in one piece;

a rail fastened to the upper part;

an alignment mechanism having a first end and a second end, the first end being fastened to said rail, and the second end comprising fastening means;

a rack formed in the lower part, and a pinion rotatably coupled to the second end of said alignment mechanism by means of said fastening means, and adapted to be housed in said lower part in order to mesh with the rack;

wherein said drawer rail assembly further comprises a rod with a first end and a second end coupled respectively to the pinion of each of said first and second support beam systems, so that the rod transfers force or torque between the pinion of the first support beam system and the pinion of the second support beam system, therefore when the drawer is pulled or pushed the rail of the first support beam system and the rail of the second support beam system slide synchronously.

10. The drawer rail assembly according to claim 9, wherein said rack comprises a plurality of valleys and a plurality of crests, wherein the valleys comprise an opening that allows free air flow or liquid flow to avoid accumulation of dirt.

11. The drawer rail assembly according to claim 9, wherein the lower part is defined by a lower wall having an upper face, a side wall and an upper wall having a lower face, wherein the rack is located in the upper face of the lower wall of the lower part, the alignment mechanism having a protrusion between the first end and the second end, the protrusion adapted to slide abutting the lower face of the upper wall of the lower part.

12. The drawer rail assembly according to claim 9, wherein the pinion comprises:

a receiving end having a first end and a second end, the second end having greater diameter than the first end, a middle part abutting the second end of the receiving end, and a meshing part abutting with the middle part, wherein the fastening means is a pin which has an opening through which the first end of the receiving end is inserted until the meshing part abuts with the second portion and until the opening surrounds, at least in part, the middle part, fastening thus the inner part of the pinion to the alignment mechanism wherein the middle part of said pinion has a plurality of grooves which diminish contact and friction between the pin and the fastening means;

wherein said receiving end houses a rod which transfers force or torque to a second pinion of a second support beam system in the opposite end of the cabinet liner; and wherein the receiving end of the pinion of the first support beam houses a first end of the rod and the receiving end of the pinion of the second support beam houses a second end of the rod.

13. The drawer rail assembly according to claim 9, wherein the support beam is fastened to the liner by means of barrels and fasteners, wherein at least one barrel protrudes from the other barrels for guiding the mounting of the support beam to the liner.

14. The drawer rail assembly according to claim 9, wherein said rod, seen from a transversal cut, has a specific shape similar to the shape of a receiving end of the pinions, the rod comprising at least one groove, opening, stop, ratchet, or any other type of device that prevents relative movement or torque loss between the rod and the pinions.

15. A home appliance comprising the drawer rail assembly of claim 9.

* * * * *